US006437259B1

(12) United States Patent
Geppert et al.

(10) Patent No.: US 6,437,259 B1
(45) Date of Patent: Aug. 20, 2002

(54) SWITCH FOR A POP-UP/SLIDING ROOF

(75) Inventors: Michael Geppert, Bingen; Wolfgang Hellwig, Hahnheim, both of (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/525,498

(22) Filed: Mar. 15, 2000

(51) Int. Cl.[7] ..... H01H 9/00
(52) U.S. Cl. ..... 200/5 R; 200/1 R; 200/1 B
(58) Field of Search ..... 200/1 R, 1 B, 200/4, 5 R, 5 B, 5 C, 6 R, 6 B–6 C, 17 R, 18, 50.32, 50.37, 517

(56) References Cited

U.S. PATENT DOCUMENTS 5,414,231 A * 5/1995 Sato et al. ..... 200/1 R
5,920,042 A * 7/1999 Gotoh ..... 200/5 R
6,046,414 A * 4/2000 Hirschfeld ..... 200/18
6,097,105 A * 8/2000 Oikawa ..... 200/5 R
6,191,372 B1 * 2/2001 Sasaki et al. ..... 200/1 R
6,239,392 B1 * 5/2001 Serizawa et al. ..... 200/5 R

* cited by examiner

*Primary Examiner*—Michael Friedhofer
(74) *Attorney, Agent, or Firm*—Thomas N. Twomey

(57) ABSTRACT

A lifting/sliding switch, in particular for the pop-up/sliding roof of a motor vehicle, comprising a housing (1), a first actuation element (5) for the sliding movement and a second actuation element (8) for effecting the pop-up movement of the roof, whereby the actuation elements (5, 8), automatically return to their home position due to a resetting arrangement and, respectively act on switch contacts (49, 50) by means of a switch member. The second actuation element (8) is an integral part of the first actuation element (5), whereby both actuation elements (5, 8) are supported in the housing (1) and the switch members are configured as rotary switch members (13, 34).

14 Claims, 3 Drawing Sheets

SWITCH FOR A POP-UP/SLIDING ROOF

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to a lifting/sliding switch, in particular for the pop-up/sliding roof of a motor vehicle. Such switches typically comprise a housing, a first actuation element for the sliding movement of the roof and a second actuation element for the pop-up movement of the roof, whereby each of said actuation elements is automatically returned into its home position by a resetting arrangement and acts on switch contacts via a switch member.

German patent publication DE 44 31 061 A1 discloses a lifting/sliding switch for the pop-up/sliding roof of a motor vehicle which switch comprises an actuation element that can be pivoted or shifted inside a housing. The actuation element is connected with a sliding switch member which is hinged to a rotary switch member, whereby a lever acts on the rotary switch member via an actuation element. The actuation element is guided by means of guide pins in a cruciform groove, as well as in a horizontal slot, whereby the essentially vertical sections of the cruciform groove represent guides for the pivoting movement and the horizontal slot represents a guide for the sliding movement of the actuation element. The horizontal sections of the cruciform groove act as additional guides for the guide pins of the actuation element during its sliding movement. In the case of this lifting/sliding switch the superimposition of simultaneous movements can lead to switching problems. When the actuation element is to be shifted, it frequently is inadvertently pivoted at the same time, whereupon the guide pins come into engagement with the essentially vertical sections of the cruciform groove and prevent the actuation element from shifting.

Also known are switch systems for opening and closing pop-up/sliding roofs, whereby two actuation elements are located next to each other in a common housing. These latter actuation elements are configured as rocker-type or sliding buttons, whereby different combinations are used. One actuation element is provided exclusively for the sliding movement and another actuation element exclusively for the pop-up movement of the roof. These switch systems require relatively substantial space because the actuation elements, in order to be easily accessible and usable, cannot be located as close to each other as is desirable.

The problem to be solved by the invention herein is to provide a lifting/sliding switch of the above-described type which functions reliably and is designed in a compact and cost-effective manner.

BRIEF SUMMARY OF THE INVENTION

In accordance with the present invention this problem has been solved in that the second actuation element is an integral part of the first actuation element, whereby both actuation elements are supported in the housing and the switch members are configured as rotary switch members.

The compact design of the lifting/sliding switch is created by integrating one actuation element in the other. Movement overlaps created by external actions affecting the actuation elements do not result in malfunctions inasmuch as each actuation element is supported individually in the housing. The association of respectively one rotary switch member with one actuation element is implemented with a relatively simple and cost-effective witch mechanism. Furthermore, a rotary switch member can be incorporated with relatively simple means and without complex guides.

Preferably, the actuation elements are associated with two-stage switch positions for opening and closing the roof. The first stage of each switch position causes a slow movement of the roof; whereas, the second stage results in a rapid movement of the roof until it has reached its travel limit or stop position.

In accordance with one advantageous embodiment of the invention, the first actuation element is configured as a sliding button and the second actuation element as a push-pull button. This configuration respectively for the buttons allows an appropriate association of the functions of the switch with those of the pop-up/sliding roof. Thus, the sliding button is associated with the roof sliding movements and the push-pull button with the roof lifting movements.

In the respectively first switch position of each actuation element, pressure is applied to the associated rotary switch element supported in the housing and, in the respectively second switch position, pressure is applied to another switch contact of a switching matrix. Furthermore, the switch contacts of the switching matrix are preferably arranged in resiliently deflectable domes at a distance from each other and covered by a common actuation plate. This arrangement allows recognition of the switch positions by touch and can be varied by changing the mechanical properties of the switching matrix.

In accordance with a modification of the invention each rotary switch member is associated with two switching matrices that are offset in parallel, as well as in longitudinal, directions. Therefore, each switching matrix represents one direction of movement of the roof.

In order to achieve favorable lever and path ratios, preferably the switching matrices associated with a rotary switch member are arranged relatively with respect to each other in such a manner that respectively one dome of one switching matrix is located essentially on a common plane with one dome of another switching matrix; and, the other domes of the switching matrices face in opposite directions. Furthermore, the essentially common plane of the domes preferably forms one plane with the axis of rotation of the rotary switch member.

In order to convert the sliding movement or the push-pull movement of the actuation elements into rotary movements for the rotary switch members, another modification of the invention comprises a deflecting arrangement between each actuation element and its associate rotary switch member.

The deflecting arrangement associated with the first actuation element comprises a strip having on its one end two pins extending through lateral bore holes of the actuation element—the pins at the same time acting as support for said actuation element in the housing—and having on its other end, which is connected with the rotary switch member, two support pins coming into engagement with housing bores. Consequently, the deflecting arrangement can be manufactured in a cost-effective manner.

In order to create a stable support in the immediate vicinity of the associated switching matrices, the deflecting arrangement, which is preferably associated with the second actuation element, has a two-arm flexible joint, whereby one of its arms is affixed to the actuation element and its other arm, which is connected with the rotary switch member, has two support pins coming into engagement with housing bores.

In order to apply uniform pressure on the actuation plates of the switch matrices, which are arranged offset with respect to each other, each rotary switch member has two actuation projections arranged in the form of a Z with respect to each other. This design saves material during the manufacture of the rotary switch member.

An adequate and relatively easily produced support is achieved in that the first actuation element is provided with guide pins arranged parallel to and at a distance from the pins of the deflection arrangement, whereby said pins and guide pins come into engagement with corresponding longitudinal holes of the housing in order to support the actuation element. The first actuation element has only two guide pins and its movement is limited by the longitudinal holes.

The second actuation element is preferably provided with lateral support pins that are molded to the deflecting arrangement and come into engagement with corresponding housing bores. This arrangement of lateral support pins in the bore holes permits the pivoting movement of the second actuation element in a pulling as well as in a pushing direction.

DETAILED DESCRIPTION OF THE INVENTION

Figure 1:
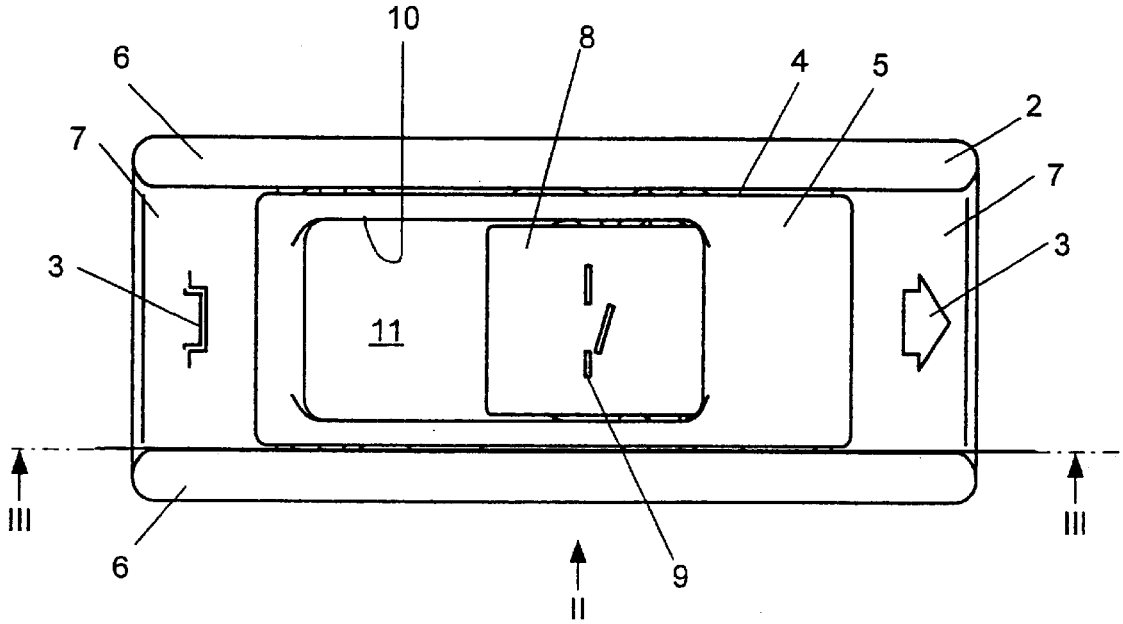
FIG. 1 is a plan view of an inventive lifting/sliding switch.

Referring to FIGS. 1 through 7, the lifting/sliding switch comprises an essentially rectangular housing 1 with a shield 2 projecting beyond housing 1, the shield 2 covering an assembly opening that receives housing 1. Optionally, backlighted symbols 3, for the functions of the lifting/sliding switch, are provided on shield 2. The underside of housing 1 is configured as a connecting collar 52.

Shield 2 has an assembly opening 4 for a first actuation element 5 which is configured as a sliding button. Assembly opening 4 is bounded by strips 6 on its longitudinal sides and by engagement recesses 7 on its end sides. A second actuation element 8, bearing a symbol 9 for a switch function, is integrated in first actuation 5 element having essentially rectangular form. Second actuation element 8 extends into a rectangular cutout 10 of first actuation element 5, whereby cutout 10 has in the area of its end side an engagement recess 11 to permit extension behind second actuation element 8 which is configured as a push-pull button.

Figure 3:
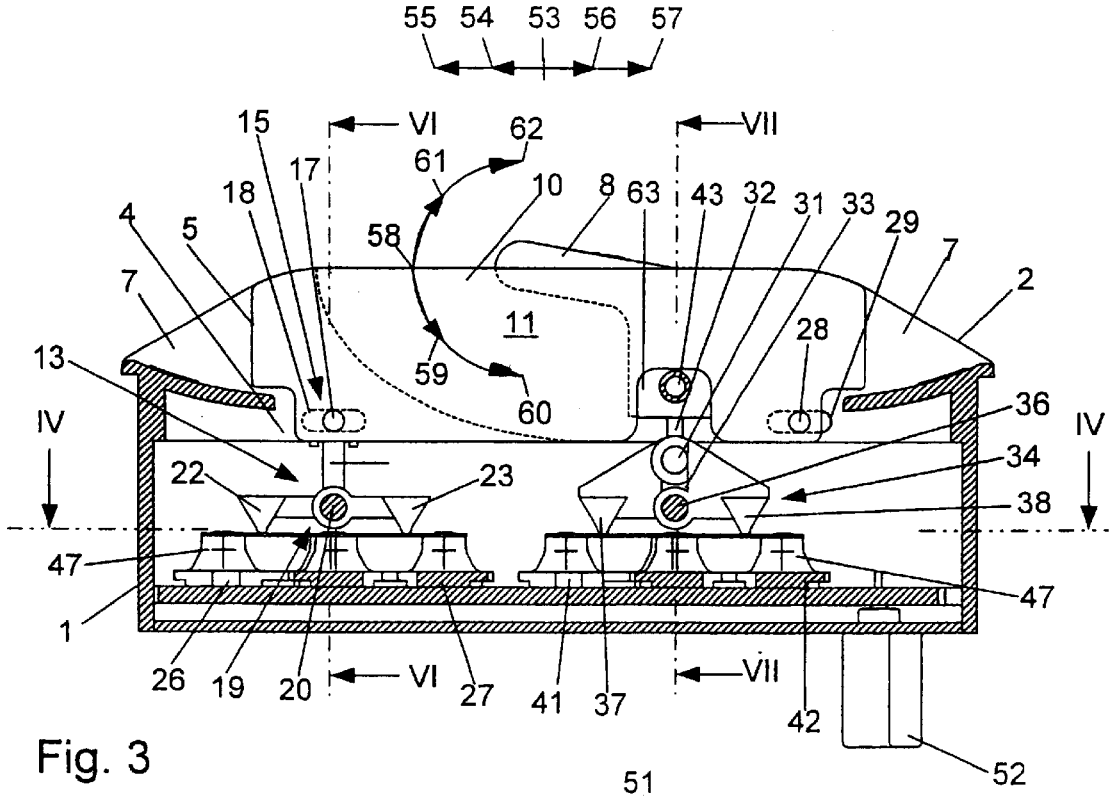
FIG. 3 is a sectional view of the illustration in accordance with FIG. 1, along line III—III.
Figure 4:
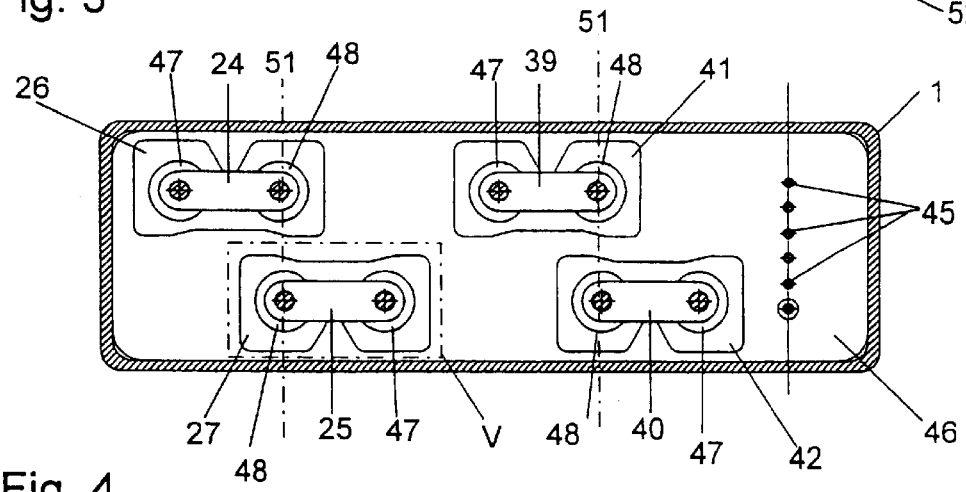
FIG. 4 is a sectional view of the illustration in accordance with FIG. 3, along line IV—IV.
Figure 5:
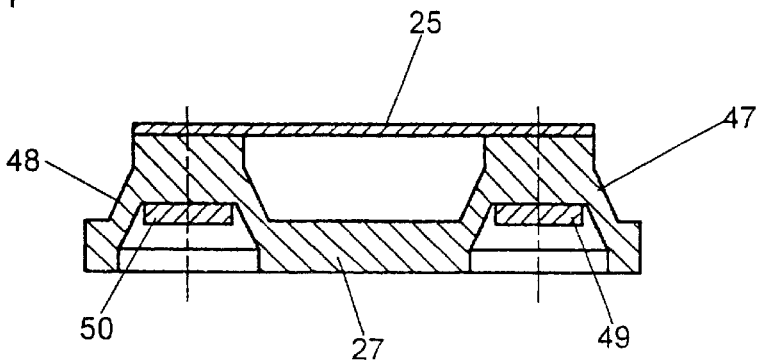
FIG. 5 is an enlarged illustration of a detail V in accordance with FIG. 4, in section.
Figure 6:
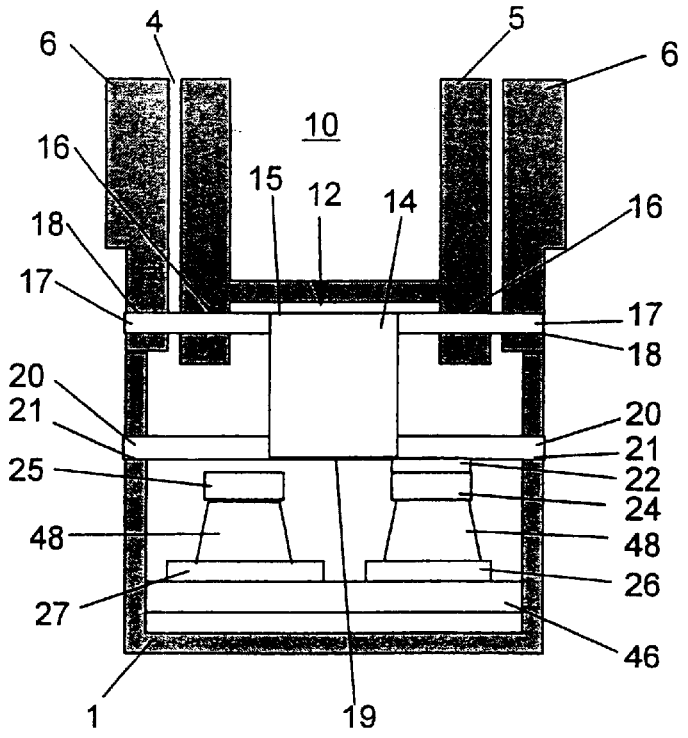
FIG. 6 is a sectional view of the illustration in accordance with FIG. 3, along line VI—VI.
Figure 7:
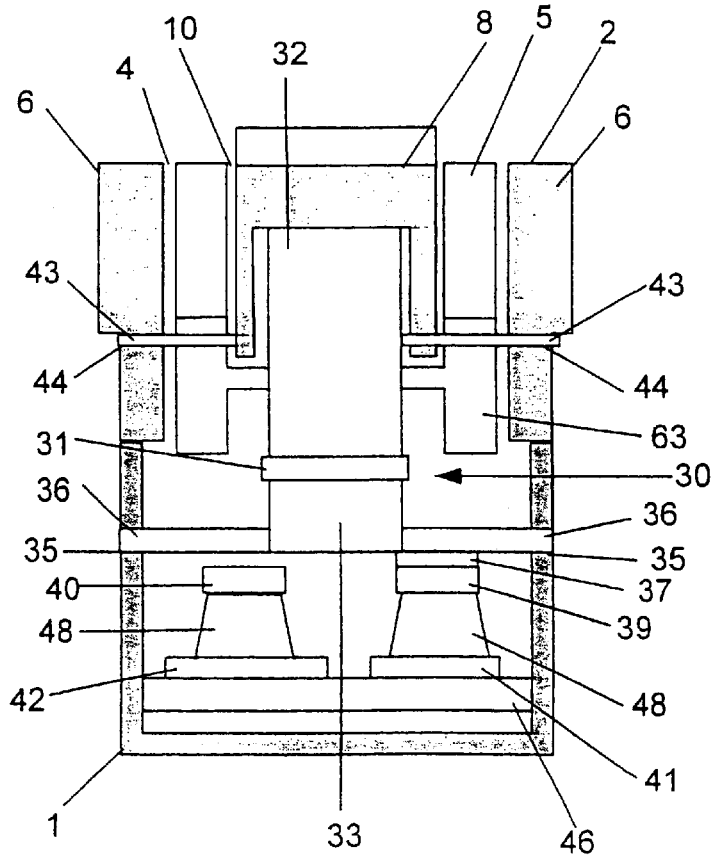
FIG. 7 is a sectional view of the illustration in accordance with FIG. 3, along line VII—VII.

The first actuation element 5 is associated with a deflecting arrangement, indicated generally at 12 in FIG. 3, enabling the application of pressure to an associated rotary switch member indicated generally at 13. Deflecting arrangement 12 comprises a strip 14 having on its one end indicated generally at 15 two pins 17 extending through lateral bore holes 16 of first actuation element 5. On their continued course, pins 17 extend into corresponding longitudinal holes or slots 18 of housing 1 and thus act as support for first actuation element 5 in housing 1. The other end indicated generally at 19 of strip 14 is connected with rotary switch member 13 and has two support pins 20 which come into engagement with corresponding housing bores 21. Rotary switch member 13 is provided with two actuation projections 22, 23 arranged in the form of a Z in plan form (not shown) with respect to each other in order to act on respectively one actuation plate 24, 25 of one switching matrix 26, 27 as will be readily apparent in view of the staggered arrangement of the switching matrix. In order to provide a stable support, first actuation element 5 has two guide pins 28 coming into engagement with longitudinal holes 29 of housing 5 in a manner parallel to as well as at a distance from pins 17 of said strip 14 of deflecting arrangement 12, whereby longitudinal holes 18, 29 limit the sliding movement of said first actuation element 5.

The second actuation element 8 also cooperates with a deflecting arrangement indicated generally at 30 which comprises a two-arm flexible joint 31. One arm 32 of a flexible joint 32 is affixed to second actuation element 8. The other arm 33 of joint 32 is connected with a rotary switch member indicated generally at 34 and has two support pins 36 which come into engagement with housing bores 35. Like rotary switch member 13, rotary switch member 34 is also provided with two actuation projections 37, 38 arranged in the form of a Z in plan form (not shown) with respect to each other in order to act on respectively one actuation plate 39, 40 of one switching matrix 41, 42. Second actuation element 8 is supported by means of lateral support pins 43 which are set in corresponding bore holes 44 of housing 5. In order to make this support possible, first actuation element 5 has clearances 63 in the area of support pins 43 of said second actuation element 8.

The construction of switching matrices 26, 27, 41, 42 placed on a printed circuit board 46 having connector contacts 45 is substantially the same and will be explained in detail hereinafter with reference to switching matrix 27. Switching matrix 27 comprises two resiliently deflectable domes 47, 48 located next to each other at a distance, whereby each dome 47, 48 receives a switch contact 49, 50. In their upper area, these two domes 47, 48 are covered by common actuation plate 25. The arrangement of respectively two switching matrices 26, 27 and 41, 42 is such that they are associated parallel and laterally offset with respect to each other with rotary switch member 13 and 34, respectively. Respectively one dome 48 of one switching matrix 26, 41 is located on an essentially common plane 51 with dome 48 of the other switching matrix 27, 42, and the other domes 47 of switching matrices 26, 27, 41, 42 face in opposite directions. The essentially common plane 51 of domes 48 forms a plane with the axis of rotation of the respectively associated rotary switch members 13 and 34.

When first actuation element 5 is slid out of a zero position 53 into a first switch position 54 associate deflecting arrangement 12 translates this linear movement of actuation element 5 into a rotary movement of rotary switch member 13. Pins 17 of strip 14 of deflecting arrangement 12 rotate in bore holes 16 of actuation element 5 and are simultaneously shifted in longitudinal holes 18 of housing 1. Strip 14 and rotary switch member 13 affixed to strip 14 are subjected to a rotary movement about support pins 20 which are set in housing bores 21. Actuation projection 22 begins to act on actuation plate 24 of switching matrix 26 as a result of which dome 47 can be felt or tactilely discerned by the switch operator to be collapsing, and switch contact 50 is moved downwardly and closes an electrical circuit. In this first-stage switch position shown by black arrow 54 in FIG. 2, a motor (not illustrated) for a pop-up/sliding roof is energized, thereby enabling the slow opening sliding movement of the roof. When actuation element 5 is released, dome 47 returns into its home or fully raised position and causes deflecting arrangement 12 to reset actuation element 5 to zero position 53 in FIG. 2. At the same time, an electrical circuit for the aforesaid motor is opened and the roof remains in the reached position.

Figure 2:
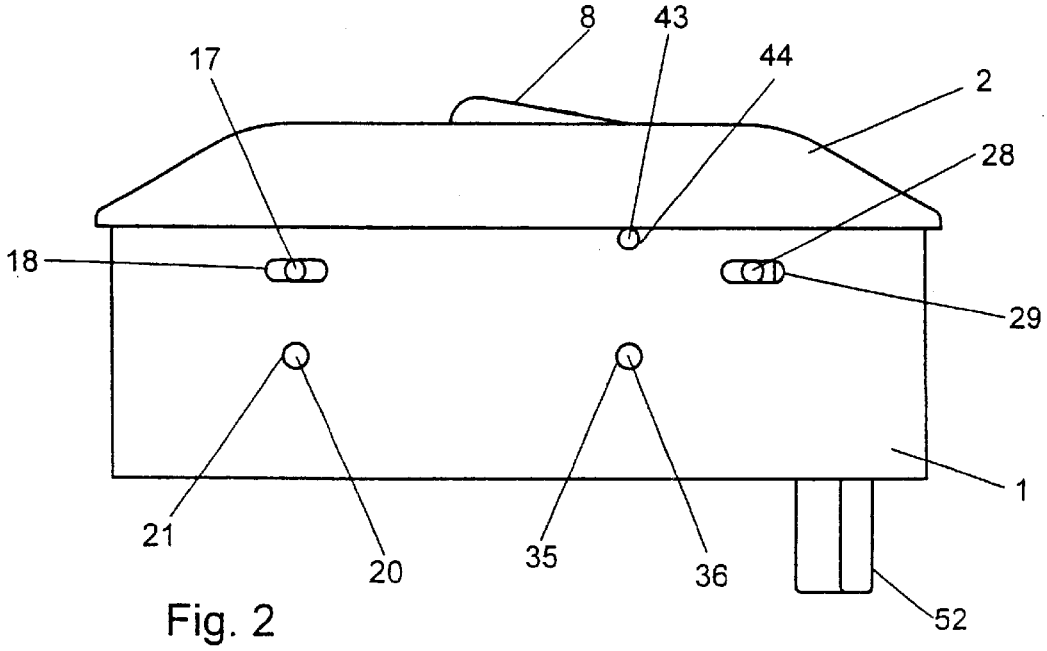
FIG. 2 is a view of the illustration in accordance with FIG. 1, in the direction of arrow II.

When the first actuation element 5 is slid into a second-stage switch position shown by black arrow 55 in FIG. 2, dome 48 of switching matrix 26 collapses as well—due to the greater switching path—after dome 47 has collapsed as described, and switch contact 50 closes another electrical circuit for motor energization, thereby enabling an opening sliding movement of the roof until it reaches its travel stop. This travel stop is also reached after the release of actuation element 5. Resetting or return of domes 47, 48 to the raised position illustrated causes actuation element 5 to be reset to its zero position 53.

The switch positions indicated by black arrows 56, 57 in FIG. 2 of first actuation element 5 enable a sliding movement for closing the roof, whereby actuation projection 23 of rotary switch member 13 acts on domes 47, 48 of switching matrix 27 and causes electrical circuits to be closed for motor energization. In this case, operation takes place in the already described manner. In order to prevent excessive stressing of the mechanical components of the switch, pins 17 and support pins 20 abut in second-stage switch positions 55, 57 against corresponding end sides of longitudinal holes 18, 29 and prevent a continued sliding movement of actuation element 5.

By applying pressure to the second actuation element 8 a lifting movement of the pop-up/sliding roof is effected. By applying pressure to actuation element 8 to move out of its zero position shown by black arrow 58 in FIG. 2 in the direction of pressure, element 8 moves into a first-stage switch position indicated by black arrow 59 in FIG. 2, whereby actuation element 8 having adjoined support pins 43 is pivoted in the bore holes 44 of housing 1. Deflecting arrangement 30 associated with actuation element 8 causes rotary switch member 34 to carry out a rotary movement toward the right. In so doing, arm 32 affixed to actuation element 8 and arm 33 connected with rotary switch member 34 move in opposite directions in housing bores 35 due to flexible joint 31, as well as due to the arrangement of support pins 36. As a result of the rotary movement of rotary switch member 34 to the right, actuation projection 38 acts on actuation plate 40 of switching matrix 42, whereby dome 47 collapses and switch contact 49 closes an electrical circuit. This causes energization of a motor (not shown) for the slow lifting opening movement of the roof. When actuation element 8 is released dome 47 returns into its home position and, by means of deflecting arrangement 80, resets actuation element 8 to zero position 58 in FIG. 2. At the same time the electrical circuit is opened de-energizing a motor (not shown) and the roof remains in the reached position.

When pressure is applied to second actuation element 8 to reach a second-stage switch position denoted by black arrow 60 in FIG. 2 the covered switch path causes, in addition to the already explained collapse of dome 47, the collapse of dome 48 of switching matrix 42, and switch contact 50 closes another electrical circuit, thereby causing energization of a motor (not shown) and a lifting movement of the roof to open it to its travel stop. The travel stop is reached even after the release of actuation element 8, whereby this release causes actuation element 8 to be reset to zero position 58 due to the resetting of domes 47, 48.

The switch positions indicated by black arrows 61, 62 in FIG. 2 of second actuation element 8, are reached by applying pressure on actuation element 8 in pulling direction, when it is deemed to cause a lowering movement to close the roof, whereby actuation projection 37 of rotary switch member 34 acts on domes 47, 48 of switching matrix 41 and causes the sequential closing of two additional electrical circuits for motor energization and operation in the above-described manner.

Although the invention has hereinabove been described with respect to the illustrated embodiments, it will be understood that the invention is capable of modification and variation and is limited only by the following claims.

What is claimed is:

1. A switch for controlling a drive motor for a moveable roof of a motor vehicle, said switch comprising a housing, a first actuation element for a sliding movement of the moveable roof and a second actuation element for a pop-up movement of the moveable roof, whereby the first and second actuation elements automatically return to a home position upon a resetting arrangement and each of the first and second actuation elements, respectively act on a first switch contact by means of a switch member, wherein the second actuation element is an integral part of the first actuation element, and both actuation elements are supported in the housing and the switch members are configured as rotary switch members.

2. The switch in accordance with claim 1, wherein each of the actuation elements for opening and closing the moveable roof is associated with two-stage switch positions.

3. The switch in accordance with claim 1, wherein the first actuation element is configured as a sliding button and the second actuation element is configured as a push-pull button.

4. The switch in accordance with claim 1, wherein, in a first switch position of each of the first and the second actuation elements respectively, pressure is applied to the first switch contact by means of one of the rotary switch members, and, in a second switch position of each of the first and the second actuation elements respectively, pressure is applied to a second switch contact, each of the first and second switch contacts being part of a switching matrix.

5. The switch in accordance with claim 1, further comprising a plurality of switching matrices, each of the switching matrices comprising a first and a second switch contact, whereby each of the first and second switch contacts are arranged in domes located at a distance from each other and covered by a common actuation plate.

6. The switch in accordance with claim 5, wherein each one of the rotary switch members is associated with two of the switching matrices and the two switching matrices associated with each one of the rotary switch members are arranged parallel as well as longitudinally offset with respect to each other.

7. The switch in accordance with claim 6, wherein the two switching matrices associated with one of the rotary switch members are positioned such that one of the domes of a first one of the switching matrices is located on essentially one common plane with one of the domes of a second one of the switching matrices.

8. The switch in accordance with claim 7, wherein the essentially one common plane forms one plane with an axis of rotation of one of the rotary switch members.

9. The switch in accordance with claim 1, wherein a first one of the rotary switch members is associated with the first actuation element, a second one of the rotary switch members is associated with the second actuation element and a first deflecting arrangement is provided between the first actuation element and the first one of the rotary switch members and a second deflecting arrangement is provided between the second actuation element and the second one of the rotary switch members.

10. The switch in accordance with claim 9, wherein the first deflecting arrangement comprises a strip having a first end and a second end; two pins extending from the first end through lateral bore holes of the first actuation element, said bore holes acting as supports for the first actuation element in the housing, and having affixed to the second end two support pins in engagement with housing bores, said second end also being connected with one of the rotary switch members.

11. The switch in accordance with claim 9, wherein the second deflecting arrangement comprises a two-arm flexible joint, a first arm being affixed to the second actuation element and a second arm being connected with the second one of the rotary switch members and the second arm having two support pins coming into engagement with housing bores.

12. The switch in accordance with claim 1, wherein each one of the rotary switch members has two actuation projections arranged in a form of a Z with respect to each other.

13. The switch in accordance with claim 10, wherein the first actuation element is provided with guide pins arranged parallel to and at a distance from the two pins that extend from the first end of the strip, the two pins extending from the first end of the strip and the guide pins engaging corresponding longitudinal holes of the housing in order to support the first actuation element.

14. The switch in accordance with claim 1, wherein the second actuation element has lateral support pins, said support pins engaging corresponding bore holes of the housing.

* * * * *